US005226655A

United States Patent [19]

Rickabaugh

[11] Patent Number: 5,226,655

[45] Date of Patent: Jul. 13, 1993

[54] APPARATUS AND METHOD OF PLAYING A BOARD GAME SIMULATING HORSE RACING AND WAGERING

[76] Inventor: Harry W. Rickabaugh, 622 E. Atlantic Ave., Altoona, Pa. 16602

[21] Appl. No.: 975,715

[22] Filed: Nov. 13, 1992

[51] Int. Cl.[5] ..... A63F 3/00

[52] U.S. Cl. ..... 273/246; 273/274

[58] Field of Search ..... 273/246, 274

[56] References Cited

U.S. PATENT DOCUMENTS

| | | | |
|---|---|---|---|
| 459,929 | 9/1891 | Fichtner | 273/246 |
| 780,937 | 1/1905 | Clagett | 273/246 |
| 2,010,558 | 8/1935 | Neuzil | 273/246 |
| 2,109,736 | 3/1938 | Roth | 273/246 |
| 2,823,919 | 2/1958 | Scruggs | 273/246 |
| 3,057,623 | 10/1962 | Barnes | 273/246 |
| 3,462,151 | 8/1969 | Parisi | 273/246 |
| 3,963,243 | 6/1976 | Contento | 273/246 |
| 5,092,605 | 3/1992 | Hoffmann | 273/246 |

FOREIGN PATENT DOCUMENTS

| | | | |
|---|---|---|---|
| 724533 | 12/1965 | Canada | 273/246 |
| 392172 | 5/1933 | United Kingdom | 273/246 |
| 601939 | 5/1958 | United Kingdom | 273/246 |

*Primary Examiner*—Benjamin H. Layno

*Attorney, Agent, or Firm*—Richard C. Litman

[57] ABSTRACT

A board game simulates the sport of horse racing and further provides for the players of the game to place wagers simulating on track betting. The game includes a game board having a race course and infield, player position markers simulating racing horses, simulated money, betting tickets, chips, and chance and odds cards. The course is divided into a series of concentric tracks with each track being occupied by a corresponding marker during a race. Players place bets using the simulated money and receive betting tickets and chips according to their bets; the chips are placed in corresponding areas of an infield portion of the board. The player position markers are advanced according to dice or other chance determination, and moves are further modified in accordance with any chance cards which come into effect in the course of play. Odds cards may also change the odds during the course of the race. The first three markers are assigned win, place and show positions and players win or lose according to their bets made prior to the race. Two or more players or teams may play, and provision is made to cause all player position markers to be played regardless of the number of actual players or teams. The game preferably comprises a series of races, with the player accruing the greatest winnings from his or her bets being the winner.

14 Claims, 4 Drawing Sheets

FIG. 2
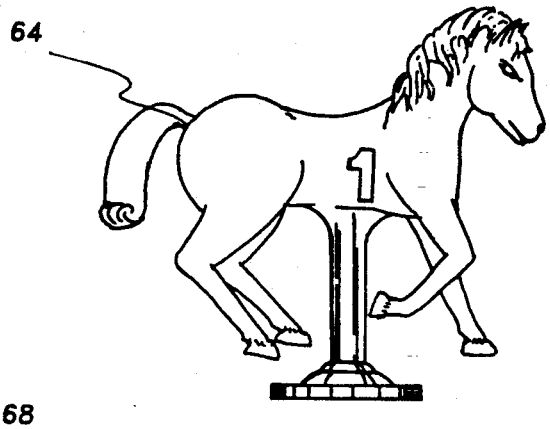
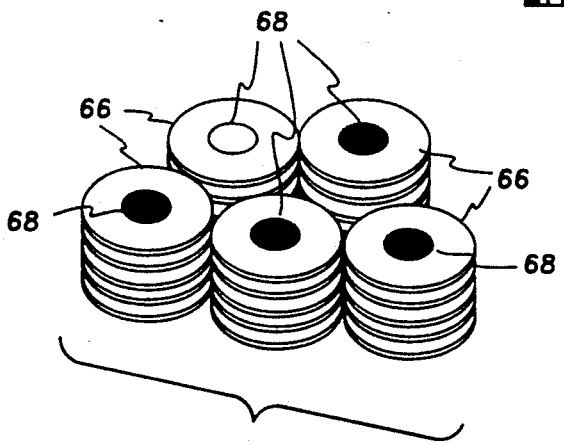
FIG.3
FIG.4
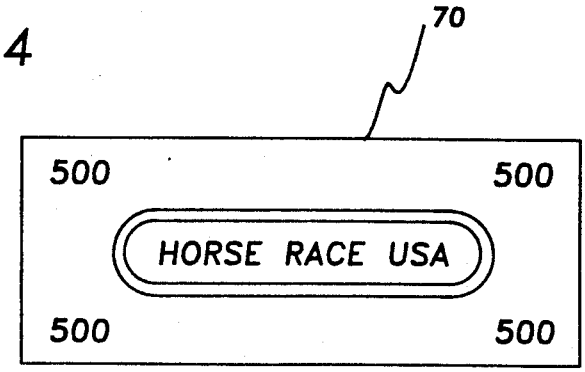

FIG.5
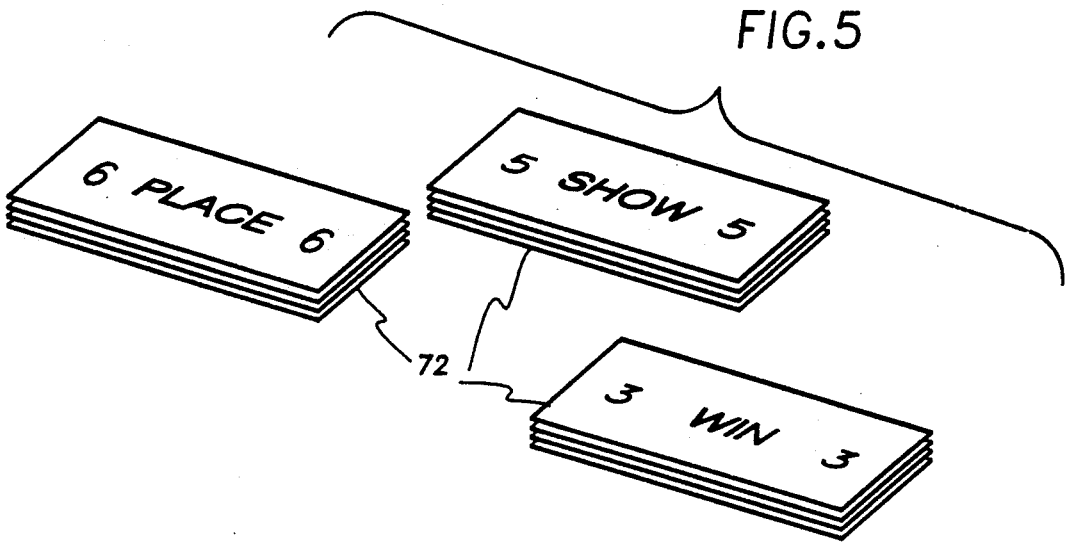
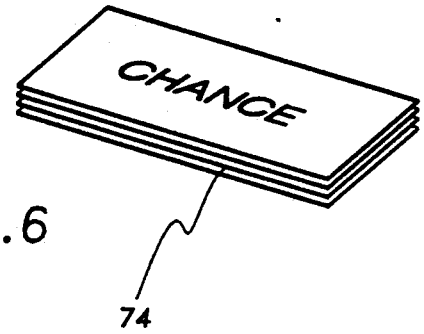
FIG.6
FIG.7
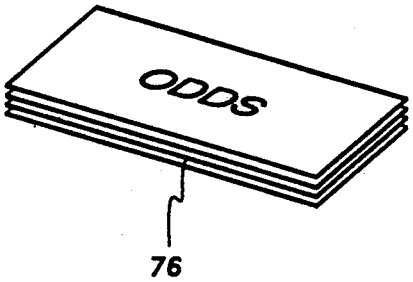
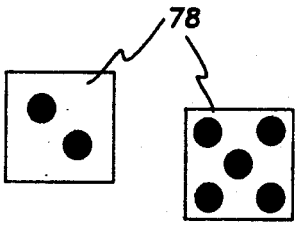
FIG.8

APPARATUS AND METHOD OF PLAYING A BOARD GAME SIMULATING HORSE RACING AND WAGERING

FIELD OF THE INVENTION

The present invention relates generally to board games, and more specifically to a board game including a simulated race track, playing position markers representing racing horses, and means providing for wagering, variation of odds, and various chance means.

BACKGROUND OF THE INVENTION

Horse racing, and particularly wagering on the outcome of such races, is one of the most popular spectator sports in the U. S., if not in the entire world. The popularity of this sport has extended itself to various board games, which board games may be enjoyed in a more passive manner in the comfort of one's home or other location removed from the race track.

As noted above, one of the reasons for the popularity of horse racing is the provision generally made for betting or wagering on the outcome of such races. While board games generally provide some element of chance by means of dice, rotary spinner, etc., they generally do not provide any specific means for wagering on the outcome of the simulated race or game, nor for considering or varying the odds on the various race entries. As horse racing and wagering on such races have become more popular, various refinements of the rules of betting (exactas, odds, etc.) have evolved, and the neophyte may be overwhelmed by such complexities and shy away from involvement in the sport.

The need arises for a board game simulating horse racing, which game provides an element of chance for the outcome to simulate an actual race. The game should also provide for variation in the odds affecting the horses or position markers, and moreover should provide a realistic simulation of the betting and rules therefor which are generally accepted as a part of horse racing.

DESCRIPTION OF THE PRIOR ART

U.S. Pat. No. 459,929 issued to Josef Fichtner on Sept. 22, 1891 discloses a Game Apparatus including a plurality of playing position markers representing race horses and a game board representing a racing track therefor. Chance means are used for the advance of the position markers according to marked positions on the game board. No disclosure is made of any apparatus or method for betting or wagering upon the outcome of the game. No means is disclosed for the determination of different odds for any of the position markers, nor for the variation of those odds before or during the course of play.

U.S. Pat. No. 780,937 issued to William H. Clagett on Jan. 24, 1905 discloses a Game Apparatus including two different concentric oval track representations on a playing board. Position markers representing horses are also provided. The chance means comprises a rotary spinner which provides for the advancement of the position markers to simulate either a steeplechase or horse race and the start for either. The chance means provides only for the advancement of the markers, and not for any variation of the odds between any of the markers.

U.S. Pat. No. 2,010,558 issued to Emil S. Neuzil on Aug. 6, 1935 discloses a Race Horse Game having a board and position markers similar to those of the patents discussed above. Chance means comprising cards are used to determine the advancement of the markers, with each marker having a specific set of cards differing from those of the other markers. Thus, each marker always possesses the same advantage or disadvantage relative to the others, and points are awarded accordingly for the winning marker. The odds for any one marker are fixed and invariable, unlike the game of the present invention.

Finally, U.S. Pat. No. 2,109,736 issued to Joseph M. Roth on Mar. 1, 1918 discloses a Game Device representing a horse race and having mechanical means for the advance of the position markers. While dice are used to determine the advance of the position markers, no means is disclosed for the determination of differing odds (if any) between the markers, nor for any variation in such odds.

None of the above noted patents, taken either singly or in combination, are seen to disclose the specific arrangement of concepts disclosed by the present invention.

SUMMARY OF THE INVENTION

By the present invention, an improved board game is disclosed.

Accordingly, one of the objects of the present invention is to provide a board game which simulates the sport of horse racing.

Another of the objects of the present invention is to provide a board game which provides chance means for the advance of the position markers, which position markers represent horses on a track.

Yet another of the objects of the present invention is to provide a board game including means for betting or wagering on the outcome of the game.

Still another of the objects of the present invention is to provide a board game which includes means for the determination of different odds for each of the position markers.

A further object of the present invention is to provide a board game which includes means for the variation of the odds for each of the position markers relative to one another during the course of the game.

An additional object of the present invention is to provide a board game in which the number of position markers in play is constant, but the number of players is variable.

With these and other objects in view which will more readily appear as the nature of the invention is better understood, the invention consists in the novel combination and arrangement of parts hereinafter more fully described, illustrated and claimed with reference being made to the attached drawings.

BRIEF DESCRIPTION OF THE DRAWINGS

FIG. 2 is a view of a playing position marker representing a race horse.

FIG. 3 is a plan view of a chip used for the placement of a wager during the play of the game.

FIG. 4 is a plan view of the simulated currency used in the play of the game.

FIG. 5 is a perspective view of tickets used for placing wagers during the game.

FIG. 6 is a perspective view of a plurality of chance cards used to alter the outcome of the game.

FIG. 7 is a perspective view of a plurality of odds cards used to vary the odds between the different position markers during the play of the game.

FIG. 8 is a perspective view of the dice used as chance determination means during the course of the game.

Similar reference characters denote corresponding features consistently throughout the several figures of the attached drawings.

DETAILED DESCRIPTION OF THE PREFERRED EMBODIMENT

Figure 1:
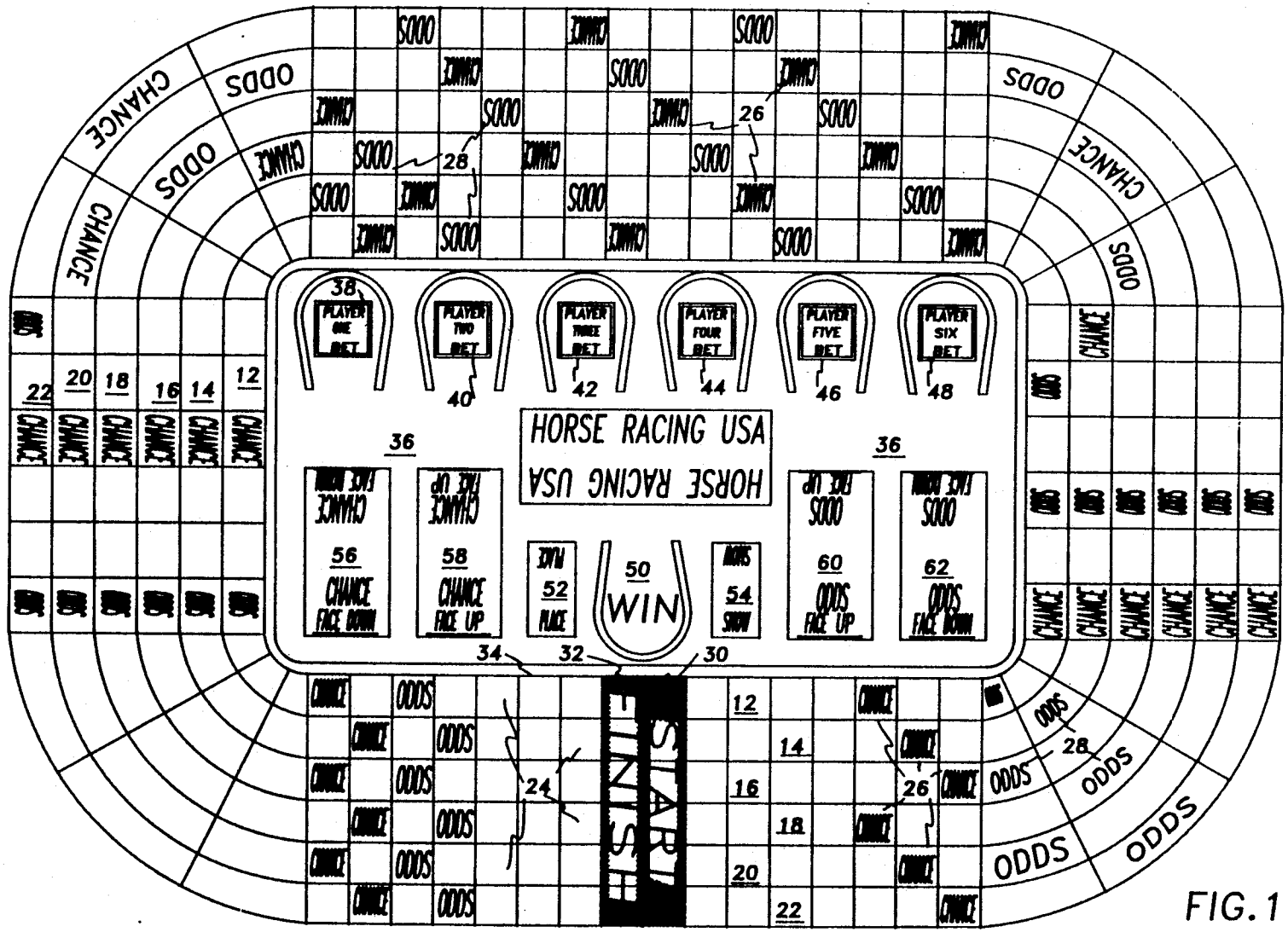
FIG. 1 is a plan view of the game board of the present invention, showing the playing area and race track representation.

Referring now to the drawings, the present invention will be seen to relate to a board game simulating the sport of horse racing, and betting or wagering on the outcome thereof. The game of the present invention includes a game board 10 providing six concentric tracks 12 through 22, from a first or inner track 12 through a sixth or outer track 22; game board 10 is shown in FIG. 1 of the drawings. Tracks 12 through 22 will generally be seen to form a rectangle having rounded corners, in the manner of many race tracks. Each of the tracks 12 through 22 includes an equal number of segments or track positions 24, with the segments 24 of the corners or turns subtending equal arcs for each of the tracks 12 through 22 in order to provide an equal number of segments 24 in each turn for each of the tracks. The equal number of segments 24 for each of the tracks 12 through 22 provide paths having an equal number of possible track positions for each of the position markers during the course of play, thus equalizing the effective lengths of the tracks for each of the position markers.

Each of the tracks 12 through 22 will be seen to include a plurality of specially marked spaces or positions along their lengths. Two different types of specially marked spaces or positions are provided: Chance spaces or positions 26, and odds spaces or positions 28. The purpose of these positions 26 and 28 will be explained further below. It will be noted that there are an equal number of chance positions 26 and odds positions 28 along each of the tracks 12 through 22, in order to equalize the probability of any one position marker along any one of the tracks 12 through 22, landing on a chance position 26 or odds position 28. However, these chance positions 26 and odds positions 28 may be located at different relative positions along each of the tracks 12 through 22 as shown on board 10, so long as their total numbers on each of the tracks 12 through 22 are equal to one another. A final feature of the tracks 12 through 22 is a start/finish line 30 located across the first through sixth tracks 12 through 22 at the median 32 of the first straight 34 of the tracks 12 through 22, in the manner of many actual race tracks.

An infield area 36 is located in the center of board 10, with the infield area 36 having an outer periphery corresponding to the inner edge of first track 12. Infield area 36 contains betting spaces 38 through 48, corresponding to the player position markers of the respective first through sixth tracks 12 through 22. Additional spaces 50 through 54 are provided respectively for win (first place), place (second place) and show (third place) position markers at the end of a given race. Finally, spaces 56 through 62 are provided respectively for the face down and face up placement of chance cards and the face up and face down placement of odds cards, which cards will be described further below.

FIG. 2 discloses a typical player position marker 64 or "horse," used to mark a given position along a specific track. As six tracks 12 through 22 are provided, six position markers 64 are also provided, one for each track, in the manner of an actual race. The position markers 64 may be differentiated by means of different colors or differently colored bases, and/or different numbers one through six on their sides. One horse or marker 64 is used by each player to mark or designate a given location or track position 24 along the specifically designated track for that player and marker.

Typically, some representation of value is used in most forms of gambling or wagering, and the game of the present invention provides chips for this purpose; a typical chip 66 is shown in FIG. 3. Chips 66 may be provided in different colors to designate different bets, and/or may include differently colored centers 68 to designate "exacta" (win and place) or "tri-exacta" (win, place and show) bets in the course of the game. For example, blue chips may be used for "win" bets, red chips for "place" bets, and white chips for "show" bets. Additional chips having red centers may be provided for "exacta" bets, while chips having blue centers may be provided for "tri-exacta" bets. For simplification, all chips 66 have the same value, for example $50.00 in the embodiment of the present game. Obviously, other colors and/or values may be provided without departing from the spirit and play of the game of the present invention.

Chips 66 are purchased in amounts corresponding to the value of the simulated currency or play money exchanged, in accordance with the rules of play which will be discussed further below. A typical currency bill 70 as used with the present game is shown in FIG. 4. Preferably, various denominations are provided, such as $50.00, $100.00, $500.00, and $1000.00. Other denominations may of course be used in addition to or in lieu of the above. Bills 70 of the appropriate denomination are used to purchase win, place, show, exacta, and/or tri-exacta chips 66 as desired during the course of the game.

FIG. 5 shows examples of tickets 72 issued to a player as a form of receipt for the placement of a bet or wager, much as such tickets are issued in actual on track betting. A player may pay an appropriate amount of simulated currency in the form of a bill 70 or bills, in exchange for the appropriate ticket(s) 72 for the specific wager desired. Tickets 72 are provided for each horse or player marker 64 (the ticket examples of FIG. 5 are for markers or horses 1, 3, and 5), and for win, place and show positions for each of those player markers or horses 64. Sufficient tickets 72 of each type are provided for the duplication of bets by all players, in the event they are needed.

Positions 56 through 62 for chance and odds cards were described above on the infield portion 36 of game board 10. Examples of chance cards 74 are disclosed in FIG. 6. Chance cards 74 are drawn singly during the course of the game in accordance with the rules disclosed below, and may provide some temporary advantage or disadvantage to the player drawing the card 74 or to other players, according to the instructions on the card. For example, a given chance card 74 may instruct the player drawing the card to move another player's horse or marker 64 rearward a given number of track positions 24; move all other players' markers 64 rearward; move that player's marker 64 forward or rearward a given amount; forfeit or take an extra turn; etc.

FIG. 7 shows a stack comprising a plurality of odds cards 76. These odds cards 76 provide for variation in the odds affecting any one horse or marker 64, for example from 2:1 to 7:1. Odds cards 76 are drawn singly by the players during the play of the game in accordance with the rules disclosed below, and vary the odds affecting the horses or markers 64 during the course of the game.

The present game may be played by from two to six players, or alternatively more players may be accommodated by means of team play with from two to six teams formed of two or more players each. In the following discussion, it will be understood that the word "player" may also be used to describe a team of two or more players. The flow chart of FIG. 9 serves to illustrate the steps involved in the play of the present game, and will be referred to below.

Before play begins, a "banker" is chosen from among the players, who will handle the chips 66, money or bills 70, and tickets 72. The order of play is also determined, with a first player having a first horse or position marker 64 and using the first track 12, a second player having a second horse or position marker 64 and using the second track 14, and so forth to accommodate as many players as necessary. The banker and order of play may be determined by mutual consent, tossing of a die or dice 78 as shown in FIG. 8, or other means acceptable to the players. The banker then distributes an equal value of bills of money 70 to each player, in accordance with step 1 of FIG. 8. Preferably, the amount provided will be sufficient to provide each player sufficient funds to bet to the limit for six races. For example, each player may be provided with $1200.00, thus allowing each player to wager $200.00 on each race for six races. Obviously, any limit(s) desired and/or agreed upon by the players may be incorporated without departing from the general scope of the game. The logic behind the provision for six races will be discussed further below.

It is important to note that all of the horses 64 or position markers will be played during the course of the game, no matter how few or how many players are playing. This is to provide reasonable odds against any one horse winning. In the case of only two players in the game, if only their own two horses/markers were being used, an obvious strategy would be for each player to bet on each horse to place, thus assuring two winning bets for each player and no losing bets. Instead, with two players the first player would move not only his/her own first marker 64, but would also be responsible for moving the two remaining odd numbered markers occupying the third and fifth tracks 16 and 20. The second player would be responsible for moving his/her second marker 64, and the remaining even numbered markers occupying the fourth and sixth tracks 18 and 22. Other variations provide for consecutive advancement in turn of all six horses or markers 64 along each of their respective first through sixth tracks 12 through 22, equitably by whatever number of players are playing the game. Thus, it is possible for only two players to play the present game, and for both players to lose if the horses 64 upon which they are betting are beaten by another of the remaining horses 64 which are occupying other tracks. The additional element of uncertainty provided by all of the markers or horses being involved in the game, no matter how few or how many players are playing, adds excitement to the present game which would otherwise be lacking if a fewer number of horses or markers 64 were in play.

Figure 9:
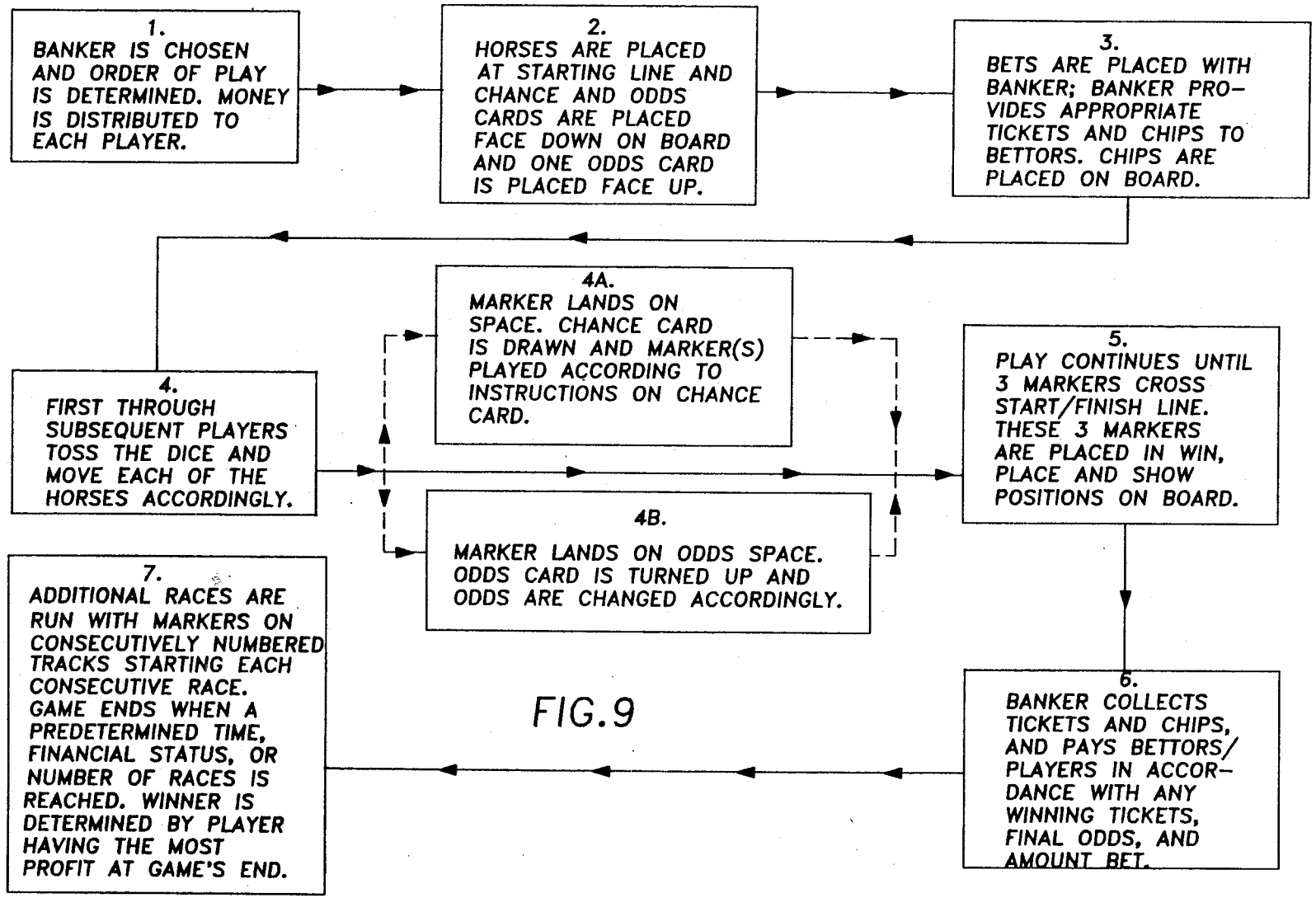
FIG. 9 is a flow chart showing the steps of the method of play of the game.

Each of the six horses or markers 64 are then placed at the start/finish line 30 on their respective first through sixth tracks 12 through 22, and the chance cards 74 and odds cards 76 are placed face down upon their respective positions 56 and 62 in accordance with step 2 of FIG. 9; the top odds card 76 is turned face up to determine the initial odds for the race and placed upon space 60 of board 10. This upwardly facing odds card 76 place upon position 62 of the board 10 will apply to all of the horses in order to simplify the play of the game, rather than each of the horses 64 having different odds. As the play of the game advances, the odds may change in accordance with play as described below, which adds an additional element of interest to the game.

As with actual on track betting, all bets must be placed before the race begins; no bets may be placed once the race portion (movement of the markers/horses 64) of the present game has started. Any player may place his or her bet with the banker by telling the banker which horse(s) or marker(s) 64 he/she wishes to bet upon and providing the banker with the appropriate sum of simulated money or bills 70. The banker will provide the player with an appropriate ticket(s) verifying the bet(s) and chip(s) of proper value for the bet(s), as described in step three of FIG. 9. Bets may be placed on a horse to win (first place), place (second place), or show (third place), and/or for exacta (first and second plate) and tri-exacta (first, second and third place) finishes.

As an example of the above, a bettor may wish to place a win bet of $100.00 on the horse or marker occupying the fourth track 18 of the board 10, a place (second place) bet of $50.00 on the horse/marker of the first track 12, and a show (third place) bet of $50.00 on the horse or marker of the fifth track 20, for a total bet of $200.00. (It is suggested that the total bet by each player for each race be limited to no more than $200.00, in order to prevent a player from losing his/her funds too rapidly in a series of several races. However, other limits, if any, may instead be incorporated.) The player transfers $200.00 to the banker and describes the bet(s) desired, whereupon the banker returns the appropriate betting tickets 72 to the player. The bettor's two win chips, a place chip and a show chip are then placed upon that bettor's/player's appropriate betting space 38 through 48 in the infield area 36 of board 10, each chip 66 having a value of $50.00. The chips 66 remain in the appropriate betting space until the race is completed (i.e., the first, second and third place horses or markers have crossed the start/finish line 30). The chips 66 are then returned to the banker, and the proper value of money or bills 70 are issued to the player, depending upon the outcome of the race corresponding with the tickets 72 issued for his/her bet and the final odds in the race.

Alternatively, a player may wish to place an exacta (win and place) bet for positions 2 and 5. One win ticket 72 will be issued for the marker or horse 64 of the second track 14, and an additional place ticket 72 will be issued for the marker or horse 64 of the fifth track 20. An appropriate amount in bills 70 is provided to the banker, who in turn issues an equivalent amount of chip(s) 66 with centers 68 designating the exacta bet.

The chips 66 are placed in the appropriate betting space 38 through 48, as described above. As the player has only bet on a first and a second place horse, he/she may also bet on an additional horse or marker to show if desired. As no more than three positions may be bet upon by a single player in any race, a tri-exacta bet precludes any further bets by that player in that race. Winning bets are paid out as described above, with the exception that exacta and tri-exacta bets include higher odds. As an example, the present game multiplies the odds by a factor of six, while a tri-exacta bet multiplies the odds by a factor of fifteen. Obviously, the odds may be adjusted as desired.

The first player, who is responsible for playing the first horse 64 occupying the first track 12, then tosses the dice 78 to determine the number of spaces or positions 24 he/she may advance his/her horse 64 and moves that horse accordingly along the first track 12 to start the actual play of the game. The second through sixth horses 64 occupying the second through sixth tracks 14 through 22 are played consecutively in a like manner by the first and/or subsequent players, depending upon the total number of players as discussed above and in accordance with step four of FIG. 9.

Due to the chance positions 26 and odds positions 28 along each of the six tracks 12 through 22, it is extremely likely that the horse or marker for each player and/or track will land upon one or more of these chance and/or odds positions 26 and/or 28 in the course of any given race. Assuming that a player's marker lands upon a chance position 26, that player must draw the top chance card 74, place it face up on the space 58 provided, and take the appropriate action as instructed by that turned up chance card 74, as described in step 4*a* of FIG. 9. The card 74 may instruct the player to advance the horse or marker of a track other than his/her own; advance all others excepting his/her own; move his/her own marker backwards a given number of positions 24; move another marker or markers rearward; skip a turn; take an extra turn; double the move rolled with the dice; etc. Other possibilities are of course conceivable.

It is important to note that the instructions of a chance card 74 apply only to the horse or marker 64 landing upon the given chance position 26 which led to the drawing of that specific chance card. If fewer than six players are playing, and (for example) the first player is also responsible for moving the second horse or marker 64 along the second track 14 and lands that second marker on a chance space 26, the instructions on the chance card 74 will apply only relative to the position of the marker on the second track 14. Thus, if the instruction is for all other markers to advance three positions, the marker on the chance position 26 of the second track 14 would remain in that position, while the markers of the first and other players on the first track 12 and third through sixth tracks 16 through 22 would be advanced three spaces. In other words, the instructions provided on the chance cards 74 are in relation to the horse or marker 64 along that particular track 12 through 22 which landed upon the chance space 26 which led to the drawing of that card 74, and not in relation to the player who happened to be playing that horse or marker 64 unless there are exactly six players each playing their own horse or marker.

The play of the odds cards 76 is handled in much the same manner, with the exception that any marker 64 occupying any of the tracks 12 through 22 and landing upon an odds position 28 and thereby causing an odds card 76 to be turned up, changes the odds for all of the markers 64. While in an actual race the odds on each horse would likely be different, an odds card 76 turned up during the play of the present game will provide the same odds for all horses or markers 64 in the interest of simplification. Step 4*b* of FIG. 9 discloses the basic concept of play of the odds cards 76. However, it will be seen that the odds will change during the course of play, thus adding a further element of chance to the financial outcome of the bets placed before the start of the actual race portion of play. The odds cards 76 will typically provide odds ranging from 2:1 to 7:1 with integer step increases in the interest of ease of calculation. Obviously, other odds may be provided as desired.

The game continues in the above manner, as described in steps four and five of FIG. 9, with each of the horses or markers 64 occupying the first through sixth tracks 12 through 22 being moved in consecutive order or as instructed by any chance cards 74 drawn according to the rules above. The race portion of the game is ended only after three horses or markers 64 have crossed the start/finish line 30. The first marker 64 to cross is placed in the winner's position 50 of the infield 36, the second place horse 64 is placed in the place position 52, and the third place horse is placed in the show position 54.

The game continues in accordance with the rules and method described above until three markers or horses 64 have advanced across the start/finish line 30 of board 10. The first horse or marker 64 to cross the start/finish line 30 is the winner, and is placed in the winner's position 50 in the infield area 36 of board 10. The game continues as the second horse or marker crosses the start/finish line 30 and is placed in the placing position 52, and the third horse or marker crosses the start/finish line 30 and is placed in the show position 54. The race portion of the game may be considered over at this point, as the fourth place through sixth place markers or horses 64 will not alter the outcome or payment of bets, no matter what the order of their finish.

The person or player acting as banker then accepts all tickets 72 from all players, and returns to each player an amount of money 70 equal to their winning bets multiplied by the odds at the end of the race. Step six of FIG. 9 provides a general description of this part of the game. As an example of the above, let us assume that the last odds card 76 turned up during the race portion of the game provided odds of 4:1, and that the horses or markers 64 occupying the first track 12, third track 16, and fifth track 20 finished respectively in first, second and third place. When the specific bet exemplified above ($100.00 to win on the marker of the fourth track, $50.00 to place on the marker of the first track, and $50.00 to show on the marker of the fifth track) is considered in combination with the hypothetical outcome above, the bettor will be seen to have two paying tickets, one for the horse/marker which occupied the first track 12 and one for the horse/marker which occupied the fifth track 20. As the horse or marker of the fourth track did not finish in the top three positions, the bettor's $100.00 bet on that position is lost. However, as the marker of the first track finished first and the bettor placed a $50.00 bet for it to at least place (finish second), the bettor receives $200.00 (due to the 4:1 final odds) for that bet. Additionally, the third place finish of the horse/marker of the fifth track also pays off $200.00, due to the 4:1 odds on an initial bet of $50.00. Thus, the player/bettor has made $400.00 on his/her $200.00 bet, for a net profit of $200.00.

While players may wish to run only one race due to time or other restrictions, preferably at least six races are run in the course of a round of play of the present game, and a horse/marker of a different track starts first with each race. For example, the horse/marker on the second track 14 may start the second race, the marker of the third track 16 may start the third race, etc. Obviously, the horse/marker 64 which starts first will have an advantage nearing the start/finish line 30 at the end of a race, as it will have the first move after an equal number of moves have been completed by all of the markers. The provision of a round of at least six races, with alternating markers having the first move in each race, cancels any advantage due to starting position in any one race. The winner of the game is the player who has made the greatest profit from his/her bets during the course of the race or races run during the course of the game.

In accordance with the above, a game is provided which not only simulates the sport of horse racing, but also includes a realistic simulation of the on track betting which normally accompanies such races. The game includes factors such as changing odds and chance circumstances which serve to enliven the course of the game, and also serves an educational function in teaching the aspects of betting or wagering to persons interested in learning.

It is to be understood that the present invention is not limited to the sole embodiment described above, but encompasses any and all embodiments within the scope of the following claims.

I claim:

1. A board game simulating horse racing and betting thereon, said board game including:

a game board having a race course and infield portion thereon;

said race course comprising a plurality of concentric tracks and including a start/finish line thereacross;

said concentric tracks each including equal numbers of playing positions, chance positions, and odds positions;

said infield portion including win, place and show positions, a plurality of betting spaces equal in number to said plurality of concentric tracks, and chance card and odds card positions;

a plurality of player position markers equal in number to said plurality of concentric tracks and marked accordingly;

a plurality of betting chips of different values;

simulated currency comprising a plurality of bills of different denominations;

a plurality of betting tickets corresponding to said win, place and show positions and said plurality of player position markers;

a plurality of chance cards and a plurality of odds cards; and chance determination means, whereby bets are placed by the players of said board game using said chips, tickets and simulated currency and each of said player position markers is advanced along a corresponding one of said concentric tracks according to said chance determination means to establish win, place and show positions to determine winning players.

2. The board game of claim 1 wherein:

said plurality of concentric tracks comprise six tracks and said plurality of player position markers comprise six player position markers.

3. The board game of claim 1 wherein:

said player position markers each have the general appearance of a racing horse.

4. The board game of claim 1 wherein:

said race course includes a first straight, and said start/finish line is located medially on and across said first straight.

5. The board game of claim 1 wherein:

said chance determination means comprise dice.

6. The board game of claim 1 wherein:

said chance cards provide for variation in the advancement of said player position markers.

7. The board game of claim 1 wherein:

said odds cards include odds varying in a range from two to one to seven to one.

8. A method of playing a board game simulating horse racing and betting thereon, said method comprising the following steps:

providing a game apparatus including a game board having a race course comprising a plurality of concentric tracks with the concentric tracks each including an equal number of playing positions, chance positions, odds positions, and a start/finish line thereacross, an infield portion, a plurality of betting positions, win, place, and show positions, and chance and odds card positions thereon, a plurality of player position markers corresponding in number to the plurality of concentric tracks and marked accordingly, a plurality of betting chips of different values, simulated currency comprising a plurality of bills of different denominations, a plurality of betting tickets corresponding to the win, place and show positions of the board and the plurality of player position markers, a plurality of chance cards, a plurality of odds cards and chance determination means;

determining the order of play by the players of the game, selecting a person to act as banker and distributing the simulated currency to the players;

placing the player position markers on their corresponding tracks at the start/finish line and the chance cards and odds cards on the appropriate chance card position and odds card position;

turning a topmost odds card face up and thereby determining the initial odds for the bets of the game;

placing bets on the player position markers corresponding to the tracks to win, place or show, placing chips corresponding to those bets in the corresponding betting positions on the board and holding tickets corresponding to the bets placed;

tossing the dice and advancing a player position marker along a first of the plurality of tracks in accordance with the advance indicated by the dice, and proceeding according to one of the three following steps;

landing upon a chance position, drawing a chance card, turning the chance card face up on the board and acting according to the instructions on the chance card;

landing upon an odds position, drawing an odds card, turning the odds card face up on the board and adjusting the odds affecting the bets of the game accordingly;

landing upon a playing position and allowing a subsequent player position marker to be played;

continuing in accordance with the above steps for subsequent players until three player position markers have crossed the start/finish line, thereby determining win, place and show positions for a single race; and collecting the tickets from the players and paying each player with the simulated currency in accordance with winning tickets of the players, the final odds of the game, and the amount bet by each player.

9. The method of claim 8 including:

providing a game board having six concentric tracks and six betting positions and further providing six player position markers corresponding to the six concentric tracks.

10. The method of claim 9 wherein:

fewer than six players advance the six player position markers, with at least one player responsible for the advance of more than one player position marker.

11. The method of claim 8 including:

playing a series comprising a plurality of races and betting thereon, with a first player position marker moving first for the first race, a second player position marker moving first for the second race, and continuing until each player position marker has moved first for each of the plurality of races of said series; and determining the winner of said series of races as the player accruing the greatest amount of total simulated currency accrued by means of any winning bets during the plurality of races.

12. The method of claim 11 wherein:

said series comprises six races.

13. The method of claim 8 including:

playing a series comprising a plurality of races and betting thereon, with a first player position marker moving first for the first race, a second player position marker moving first for the second race, and continuing in the above manner until a predetermined time period has elapsed; and determining the winner of said series of races as the player accruing the greatest amount of total simulated currency accrued by means of any winning bets during the plurality of races at the end of the predetermined time period.

14. The method of claim 8 including:

playing a series comprising a plurality of races and betting thereon, with a first player position marker moving first for the first race, a second player position marker moving first for the second race, and continuing in the above manner until a player has accrued a predetermined amount of simulated currency; and determining the winner of said series of races as the player first accruing the predetermined amount of simulated currency accrued by means of any winning bets during the plurality of races.

* * * * *